US006545651B2

(12) United States Patent
Nishigaki et al.

(10) Patent No.: US 6,545,651 B2
(45) Date of Patent: Apr. 8, 2003

(54) DRIVING CIRCUIT FOR ORGANIC THIN FILM EL ELEMENTS

(75) Inventors: Eitaro Nishigaki, Tokyo (JP); Shingo Kawashima, Tokyo (JP)

(73) Assignee: NEC Corporation, Tokyo (JP)

( * ) Notice: Subject to any disclaimer, the term of this patent is extended or adjusted under 35 U.S.C. 154(b) by 41 days.

(21) Appl. No.: 09/923,989

(22) Filed: Aug. 7, 2001

(65) Prior Publication Data

US 2001/0048410 A1 Dec. 6, 2001

Related U.S. Application Data

(63) Continuation of application No. 09/085,731, filed on May 27, 1998.

(30) Foreign Application Priority Data

May 29, 1997 (JP) ..... 9-139984

(51) Int. Cl.[7] ..... G09G 3/30

(52) U.S. Cl. ..... 345/76; 345/82

(58) Field of Search ..... 345/76, 82, 55; 315/169.1, 169.3, 169.4, 169.2; 313/483, 498

(56) References Cited

U.S. PATENT DOCUMENTS 5,198,803 A * 3/1993 Shie et al. ..... 345/82
5,844,368 A * 12/1998 Okuda et al. ..... 315/169.3
6,310,589 B1 * 10/2001 Nishigaki et al. ..... 345/76

* cited by examiner

*Primary Examiner*—Richard Hjerpe
*Assistant Examiner*—Francis Nguyen
(74) *Attorney, Agent, or Firm*—Michael, Best & Friedrich, LLC

(57) ABSTRACT

A pulse generator 1 creates a pulse in synchronization with a driving pulse 26. A charging circuit 2 charges EL elements 20 only for a period which is determined by an output from the pulse generator 1. The charging time is determined by resistance of a switching element 3 in its on condition and a junction capacity of the EL elements 20.

10 Claims, 14 Drawing Sheets

DRIVING CIRCUIT FOR ORGANIC THIN FILM EL ELEMENTS

This is a continuation of Ser. No. 09/085,731 filed May 27, 1998.

BACKGROUND OF THE INVENTION

1. Field of the Invention

The present invention relates to a driving circuit for organic thin film EL elements which utilizes an electro luminescence (EL) phenomenon of organic thin films, and more specifically a driving circuit for organic thin EL films which is to be used for displaying characters and figures by driving a matrix of EL elements.

2. Description of the Prior Art

There is known a fact that when a certain organic thin film which is interposed between an anode and a cathode is electrically energized, positive holes and electrons poured from the respective electrodes recombine with each other in the organic film, whereby a luminescent phenomenon takes place due to energies produced by the recombination. This phenomenon is referred to as an organic thin film EL. Since an organic thin film EL element has merit that it can be driven with a DC voltage on the order of several to ten-odd volts, emits rays at a higher efficiency, and is thinner and lighter in weight than other display devices, researches are now being made vigorously for application to various kinds of light-emitting devices.

Though the EL phenomenon can take place even when an organic thin film which is capable of transmitting light (hereinafter referred to as an organic light-emitting thin film layer) is composed of a single layer, it is necessary for obtaining high luminance at a low voltage to pour a carrier from each electrode into the organic light-emitting thin film layer with an enhanced efficiency. Accordingly, there have been proposed laminated structures wherein additional carrier pouring layers or carrier transport layers are interposed between electrodes and organic light-emitting thin film layer for lowering energy barriers between the electrodes and the organic light-emitting thin film layers, thereby facilitating to shift carriers into the organic light-emitting thin film layers. For example, Japanese Patent Application Laid-Open No. 57-51781 proposes a structure which is composed of an anode/an organic positive hole transport layer/an organic light-emitting thin film layer/a cathode and Japanese Patent Application Laid-Open No. 6-314594 proposes a structure which is composed of an anode/a plurality of organic positive hole pouring transport layer/an organic light-emitting thin film layer/a plurality of organic electron pouring transport layer/a cathode. The laminating sequence may be reversed. FIG. 5 shows a sectional view of an organic thin film EL element having a general laminated structure which is composed of an anode/an organic positive hole transport layer/a light-emitting thin film layer/a cathode formed on a support substrate, and means for applying a voltage to this element.

Materials which are used for composing the organic thin film EL element will be described with reference to FIG. 5. Speaking of electrodes first, at least one of the cathode and anode must be transparent since light must he taken out of the organic light-emitting thin film layer. In most cases, a thin film of indium-tin oxide (ITO) or a thin film of gold is used as an anode 31. On the other hand, a material which has a small work function is selected for a cathode 34 for the purpose of lowering a pouring barrier to electrons and a film of a metal such as magnesium, aluminium, indium or an alloy thereof is used as the cathode 34. Aromatic amine class 3, a polyphyrine derivative or the like is used as an organic positive hole transport layer 32 and 8-hydroxyquinoline metal complex, a butadiene derivative, a benzoxadole derivative or the like is used as an organic light-emitting thin layer 33. In case of a structure which has an organic electron transport layer, a naphthalimide derivative, a perylene tetracarbonate di-imide derivative, quinacridon derivative or the like is additionally used though the organic thin film EL element shown in FIG. 5 does not use such a substance. The electrodes and the organic thin film layers are formed on a support substrate made of a glass or resin material by a dry film forming method such as vacuum deposition or sputtering or by a wet film forming method such as spin coating or dipping by gradually laminating the material mentioned above from a solution in which the material mentioned above is dissolved or dispersed. When a transparent electrode (the anode 31 in this case) is formed as a first layer, a support substrate 30 must also be made of a transparent substance.

When a voltage is applied to an EL element which is composed as described above, it exhibits a voltage-current characteristic like that of a diode as shown in FIG. 6. It is therefore general to drive the element with a current.

As devices to which organic thin film EL elements having structures and electric characteristics like those described above are applied, there have conventionally been proposed planar surface light-transmitting type organic thin film EL displays which drive matrices of organic thin film EL elements exemplified above as unit picture elements arranged in two dimensions on planar surfaces of support substrates. Japanese Patent Application Laid-Open No. 7-36410 discloses an example (conventional example 1) of such a device. Referring to FIG. 7 which illustrates a theoretical circuit of a driving circuit of a conventional example 1 proposed by this Japanese patent, a display panel 10 is driven by an X driver 12 and a Y driver 14. A matrix of the display panel 10 is composed of signal electrodes 16-0, 16-1, 16-2, . . . from the X driver 12 and scanning electrodes 18-0, 18-1, . . . from the Y driver 14. A light-emitting element 20 is connected to each intersection of the matrix. The X driver 12 comprises constant-voltage power sources 22-0, 22-1, 22-2, . . . which receive a driving pulse signal 26 together with a power source voltage (=+V) from a control computer 24 and output a constant current for igniting the light-emitting elements to the signal electrodes 16-0, 16-1, 16-2, . . . . Further, the Y driver 14 comprises switch elements 28-0, 28-1, . . . which are turned on and off by a control signal 29 from the control computer 24 to connect and disconnect the scanning electrodes 18-0, 18-1, . . . to and from ground, thereby driving a matrix.

FIG. 11 illustrates a more concrete composition of the circuit shown in FIG. 7 described above.

In FIG. 11, a video signal is supplied to a shift register 38 used as a memory by way of an A/D converter 36 which comprises a plurality of flip-flop circuits (hereafter referred to as FFs) 44 through 44. Signals from the FFs in the shift register 38 are supplied to PWM modulators 48 through 48 by way of FFs 46 through 46 in an X driver 40. Signals (analog signals indicating pulse widths corresponding to luminance data) from the PWM modulators 48 through 48 are supplied to signal electrodes A0, A1, A2, A3, . . . , whereas signals from FFs 50 through 50 in a Y driver 34 are supplied to scanning electrodes K0, K1, K2, K3, . . . , whereby a matrix of a display panel 30 is composed of the signal electrodes A0, A1, A2, A3, . . . and the scanning electrodes K0, K1, K2, K3, . . . . Light emitting elements 52 through 52 are connected to the signal electrodes A0, A1, A2, A3, . . . and the scanning electrodes K0, K1, K2, K3, . . . at intersections between the signal electrodes A0, A1, A2, A3, . . . and the scanning electrodes K0, K1, K2, K3, . . .

A timing generator 42 which is used as a controller receives a horizontal synchronizing signal and a vertical synchronizing signal, and outputs signals SCLK, LCLK, FPUL and FCLK. The signal SCLK is supplied to the A/D converter 36 and the FFs 44 through 44 in the shift register 38, the signal LCLK is supplied to the FFs 46 through 46 in the X driver 40, and the signals FPUL and FCLK are supplied to the FFs 50 through 50 in the Y driver 34.

Describing with reference to a timing chart of the X driver shown in FIG. 12(A), data DATA which has been subjected to A/D conversion is shifted sequentially to the FFs 44 through 44 in the shift register 38 by the signal SCLK each time the video signal is subjected to A/D conversion and sampled. When all the data DATA in a single horizontal synchronizing period is sent to the FFs 44 through 44, data in the FFs 44 through 44 is supplied by the signal LCLK to the PWM modulators 48 through 48 by way of the FFs 46 through 46 in the X driver 32. The PWM modulators 48 through 48 perform PWM modulation of the sent data and output pulses having lengths corresponding to the data to the signal electrodes A0, A1, A2, A3, . . . .

Describing with reference to a timing chart of the Y driver shown in FIG. 12(B), the signal FPUL is set at a "High" level once during a vertical synchronizing period and a pulse of the signal FPUL is transmitted by the signal FCLK sequentially to the scanning electrodes (lines) K0, K1, K2, K3, . . . . When a scanning line Kn (n=0, 1, 2, 3, . . . ) is ignited when it is set at the "High" level. The signal FCLK outputs a pulse during one horizontal synchronizing period and the signal FPUL outputs a pulse during one vertical synchronizing period.

Japanese Patent Application Laid-Open No. 7-36410 mentioned as the conventional example 1 discloses a method which drives light-emitting elements arranged in a shape of a matrix with a constant current as described above.

Further, Japanese Patent Application Laid-Open No. 3-157690 discloses a second method (conventional example 2) which is conventionally used for driving a thin film EL display. It is a driving method for displaying gradations by applying a pulse width modulation system to a display unit EL in which EL elements are interposed between a plurality of scanning side electrodes and a plurality of data side electrodes arranged in directions intersecting with each other, and configured to drive a thin film EL display by using, as a voltage to be applied to each picture element on selective scanning electrodes, a pulse voltage having waveform in which a crest at a front portion of a pulse is higher than that at a rear portion of the pulse. Referring to FIG. 8 which shows the pulse waveform obtained by the conventional example 2, a pulse waveform in a light-emitting condition at maximum luminescence B max is illustrated in FIG. 8(*a*), a pulse waveform in a light-emitting condition at medium luminescence BX is illustrated in FIG. 8(*b*), and a pulse waveform in a non-light-emitting condition (luminescence B0) is illustrated in FIG. 8(*c*). This method uses a lamp voltage having a waveform which lowers a crest from the front portion of the pulse to the rear portion of the pulse. The driving method according to the conventional example 2 is used mainly for driving an EL display which has a first field and a second field and, is driven with an AC voltage. This method is configured to cancel electric charges accumulated in light-emitting layers composing picture elements by applying a high voltage (Vw) at an initial light-emitting stage for displaying gradations free from luminance ununiformities when EL elements are operated with an effective voltage (Vw2) in the vicinity of a threshold value for light emission free from influences due to accumulated electric charges. The conventional reference 2 is an invention which relates to a method for driving the EL elements with an AC voltage.

A first problem proposed by the prior art described above is that luminance is not enhanced due to retardation in rise of pulses when the EL elements are driven with a square pulse signal in the planar surface light-emitting type organic thin film EL display according to the conventional example 1 in which the constant-current driving signals are supplied to the signal electrodes dependently on input signals. Since the organic thin film EL elements have a junction capacity, the capacity is charged first upon driving with the constant current, whereby a certain time is required until a voltage is enhanced to a level at which a light-emitting operation starts.

Extracting only a portion of the circuit diagram shown in FIG. 7 which corresponds to a single picture element for simplicity of description or facilitating understanding, the conventional example 1 drives an organic thin film EL element 20 with a circuit illustrated in FIG. 9. When the organic EL element 2 is driven with a square pulse signal 26, a pulse voltage indicated by OAPQ of a voltage waveform shown in FIG. 10 is applied to the EL element 20. In FIG. 10, a voltage VF along the ordinate is a forward voltage of the EL element and a voltage Va is a voltage at which the EL element starts emitting light. A time ta along the abscissa is a time as measured from a start of driving with the pulse to a start of the light emission. Further, a time T is a duration of time during which the driving pulse is applied to the EL element, or approximately 104 $\mu$s when the EL element is driven for dynamic ignition at 1/64 duty and a repetition frequency of 150 Hz.

Referring to FIG. 10, it will be understood that the EL element emits light actually for a time of (T−ta) though the driving pulse is originally applied to the EL element for the time T and that luminance of the emission is lowered at a degree corresponding to the time ta. Speaking of a concrete example, a junction capacity is approximately 670 pF and the time ta is approximately 30 $\mu$s when the EL element has a size of 0.52 mm×0.52 mm. The time ta=30 $\mu$s is not negligible as compared with the time T=104 $\mu$s. Since peak luminance lies at 13800 cd/m$^2$ (at a DC current), mean luminance is remarkably lowered to 126 cd/m$^2$ though it should originally be 216 cd/mm$^2$. When a matrix has a larger scale and a duty is reduced, the time T is shortened with the time ta kept unchanged. At ta>T, the EL element cannot emit light.

Then, the prior art poses a second problem that the planar surface light emitting type thin film EL display according to the conventional example 1 shortens a service lives of the EL elements. Luminance of the EL elements is determined dependently on current levels. Therefore, it is necessary to set a current level higher than required or supply a current in a larger amount to the EL elements in order to obtain required luminance without correcting the slow rise of the driving pulse described above. As a result, heating of the EL elements accelerates deterioration of these elements.

SUMMARY OF THE INVENTION

It is therefore a primary object of the present invention to provide a driving circuit for organic thin film EL elements which is capable of preventing luminance from being lowered even when capacitive elements are driven.

Another object of the present invention is to prolong service lives of organic thin film EL elements to a predetermined potential.

The driving circuit for organic thin film EL elements according to the present invention is a driving circuit for a matrix of a plurality of organic thin film EL elements which comprises light emitting layers made of an organic substance, and signal electrodes and scanning electrodes which are disposed on both sides of the light emitting layers and either of which are transparent, characterized in that the driving circuit comprises current driving means which supplies a constant-current driving signal to the signal electrodes dependently on an input signal, a pulse generator which outputs a pulse in synchronization with an output from the current driving means and a charging circuit which charges a junction capacity of the organic thin film EL elements to a predetermined potential with an output from the pulse generator.

In the driving circuit for organic thin film EL elements according to the present invention, a charging circuit which charges the EL elements to a predetermined potential with the output from the pulse generator at a driving rise time of the EL elements is disposed in the current driving means which supplies the constant current driving signal for driving the EL elements. Accordingly, the driving circuit is capable of accelerating the driving rise of the EL elements and preventing luminance from being lowered even with capacitive elements.

BRIEF DESCRIPTION OF THE DRAWINGS

This above-mentioned and other objects, features and advantages of this invention will become more apparent by reference to the following detailed description of the invention taken in conjunction with the accompanying drawings, wherein.

DETAILED DESCRIPTION OF THE PREFERRED EMBODIMENTS

Figure 1:
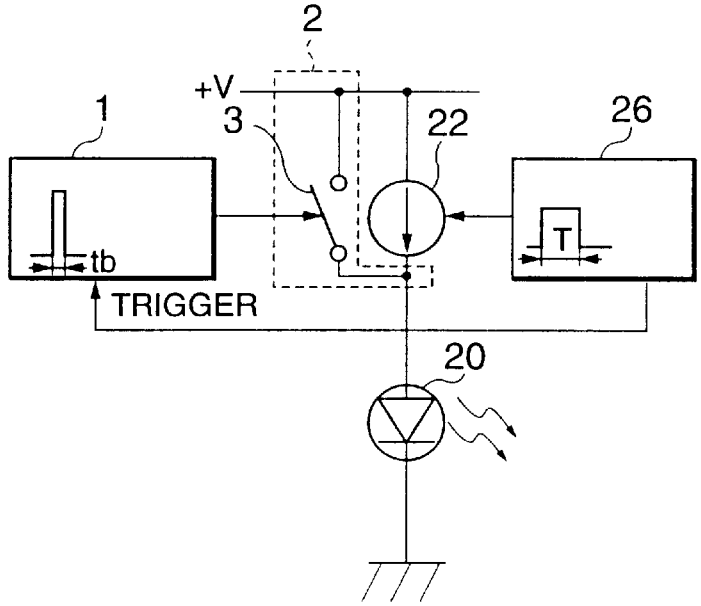
FIG. 1 is a block diagram illustrating a circuit corresponding to a single picture element of a first embodiment of the driving circuit according to the present invention.

Now, the preferred embodiments of the present invention will be described with reference to the accompanying drawings. First, description will be made of basic operations of a first embodiment of the present invention. A block diagram descriptive of an operating principle of the driving circuit according to the present invention is shown in FIG. 1, wherein only a portion of a circuit for driving elements disposed in a shape of a matrix which corresponds to a single picture element is shown. Referring to FIG. 1, a charger circuit 2 has a switching element 3. A pulse generator 1 is triggered by a driving pulse 26 and outputs a pulse having a width tb which is far narrower than a width T of a driving pulse, thereby making the switching element 3 conductive. When the switching element 3 is conductive, a power source voltage +V is applied directly to an EL element. Then, a current which has so far been restricted by a constant current source 22 is released and supplied to an EL element 20, thereby rapidly charging a junction capacity of the EL element 20. A duration tb during which the switching element is turned on is preliminarily set as a duration sufficient for charging the junction capacity of the EL element 20. Since the constant-current source 22 is also driven by the driving pulse 26, the current supplied to the EL element 20 is in a condition where it a sum of the driving pulse and the current supplied through the switching element.

Figure 2:
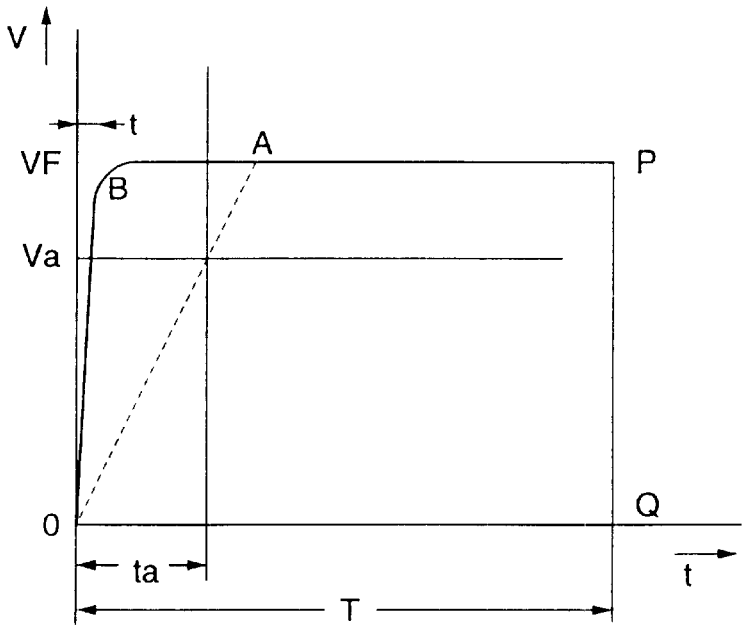
FIG. 2 is a diagram illustrating a pulse waveform in the first embodiment.
Figure 10:
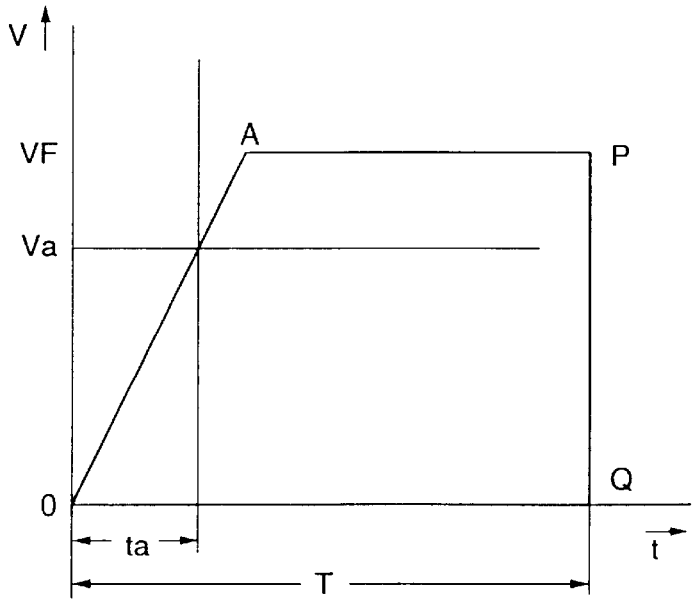
FIG.10 (PRIOR ART)
FIG. 10 is a diagram illustrating a pulse waveform in the conventional example 1.
Figure 11:
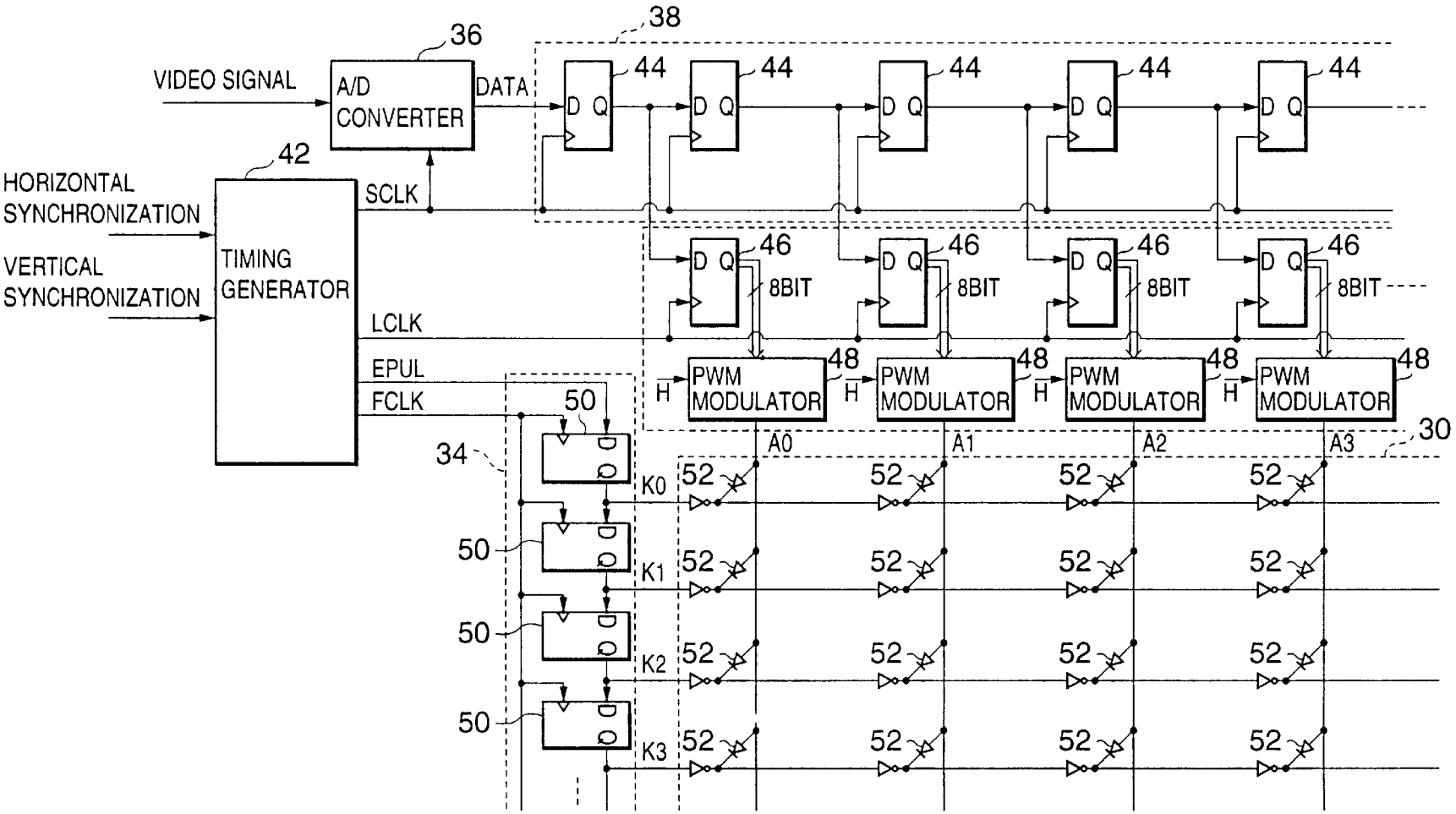
FIG.11 (PRIOR ART)
FIG. 11 is a block diagram illustrating a circuit composition in a display device according to the conventional example 1.
Figure 12:
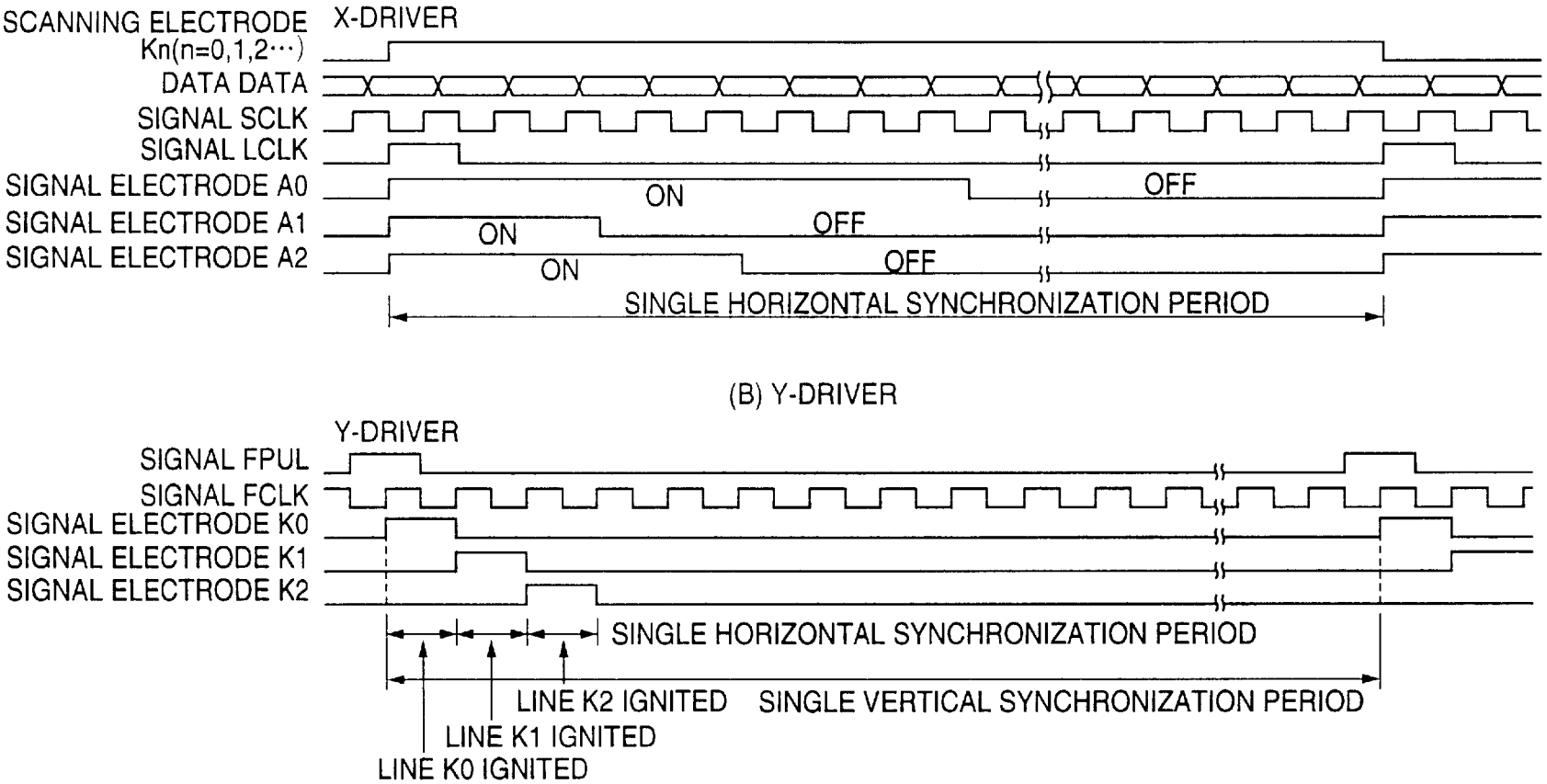
FIG.12 (PRIOR ART)
FIG. 12 is a timing chart for the display device according to the conventional example 1.

FIG. 2 shows a shape of a pulse applied to the EL element 20 in the first embodiment. Though the constant current driving method according to the conventional example 1 drives an EL element with a pulse which has the shape indicated by OAPQ in FIG. 10, the first embodiment of the present invention drives the EL element with a pulse which has a shape indicated by OBPQ shown in FIG. 2. A rise time $\tau$ of the pulse OBPQ is determined dependently on a time constant which in turn is determined by a resistance of the switching element 3 in its on condition and a junction capacity of the EL element 20. Since the rise time $\tau$ is sufficiently short as compared with the pulse width T, lowering of luminance for this time $\tau$ is practically negligible. Speaking of a concrete example, the driving pulse is applied for approximately 104 $\mu$s when the EL element is driven for dynamic ignition at 1/64 duty and a repetition frequency of 150 Hz. Though the rise time $\tau$ of the pulse OBPQ is variable dependently on a voltage applied to the EL element 20 and the resistance of the switching element 3 in its on condition, a mean luminance is improved from 126 cd/m$^2$ (luminance in the conventional example 1) to 211 cd/m$^2$ and is scarcely problematic for practical use by selecting values (of the voltage to be applied to the element and the width tb) so as to obtain, for example, $\tau$=2 $\mu$s.

It is possible to select an optional voltage other than a power source voltage as the voltage to be applied to the EL element.

Figure 3:
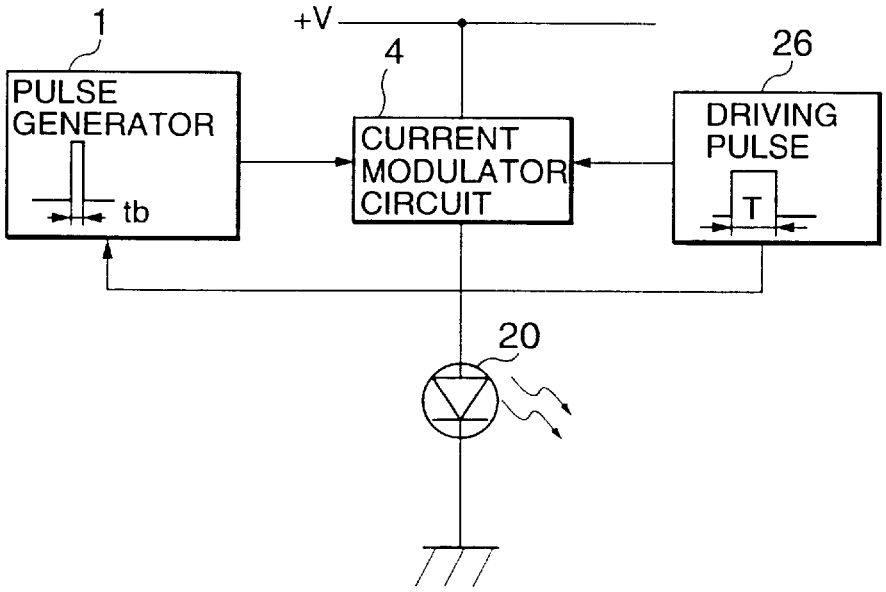
FIG. 3 is a block diagram illustrating a circuit for a single picture element in a second embodiment of the driving circuit according to the present invention.

Now, description will be made of a second embodiment of the present invention. FIG. 3 is a block diagram illustrating the second embodiment of the present invention. Differently from the first embodiment, the second embodiment uses a current modulator circuit 4 which modulates a current from a constant-current source 22. The current modulator circuit 4 is composed, for example, of the constant-current source 22 which is used in the first embodiment and a switching element (transistor) 5 which is used as a charging circuit incidental thereto.

Figure 4:
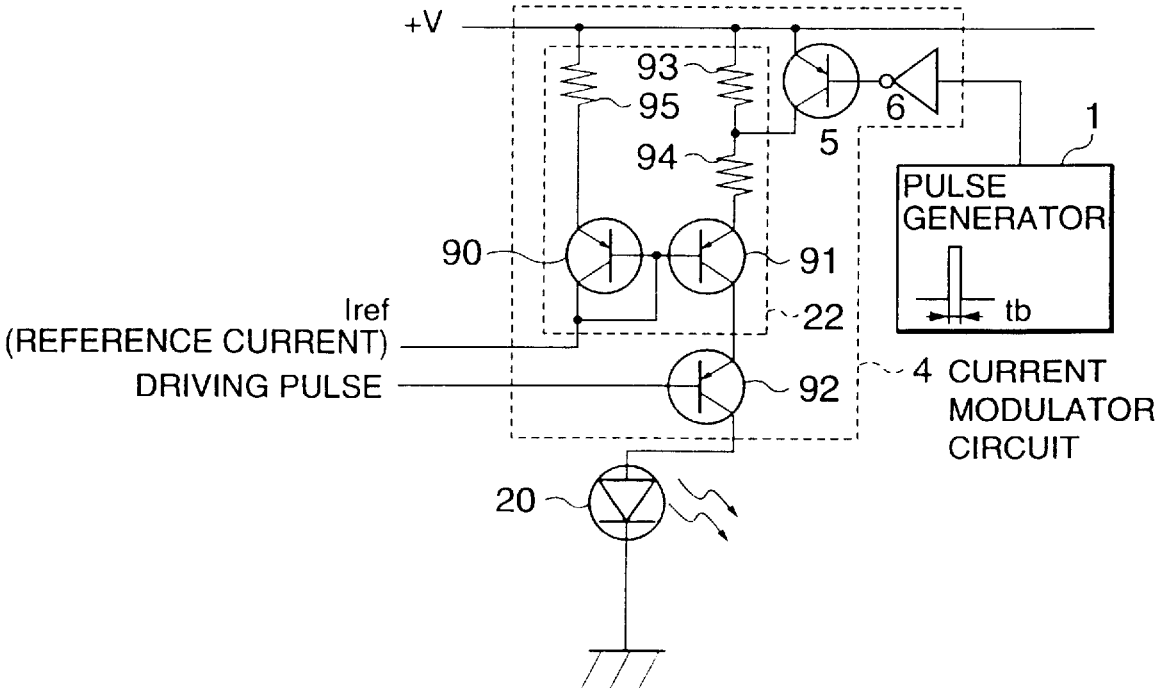
FIG. 4 is a diagram illustrating a circuit on a level of transistors for a single picture element in the second embodiment.
Figure 5:
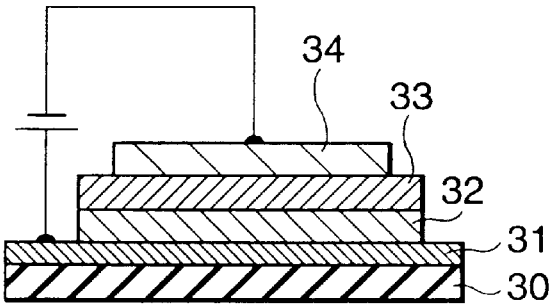
FIG.5 (PRIOR ART)
FIG. 5 is a diagram illustrating an example of a structure of an organic thin film EL element and an voltage application method.
Figure 6:
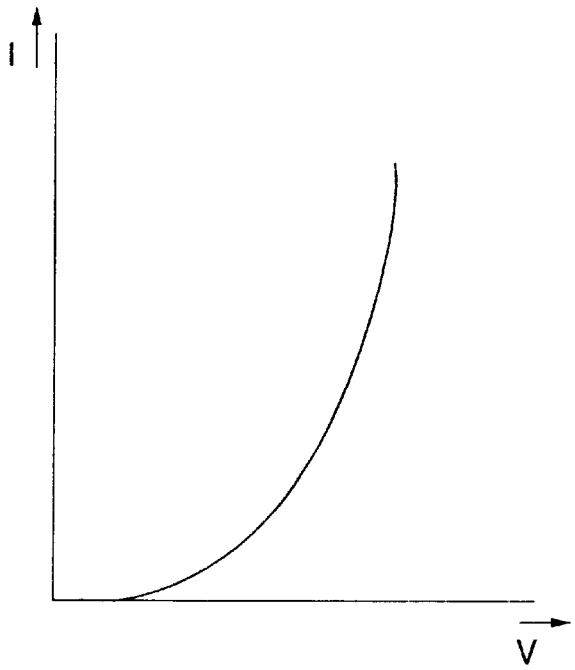
FIG.6 (PRIOR ART)
FIG. 6 is a curve exemplifying a current-voltage characteristic of an organic thin film EL element.
Figure 7:
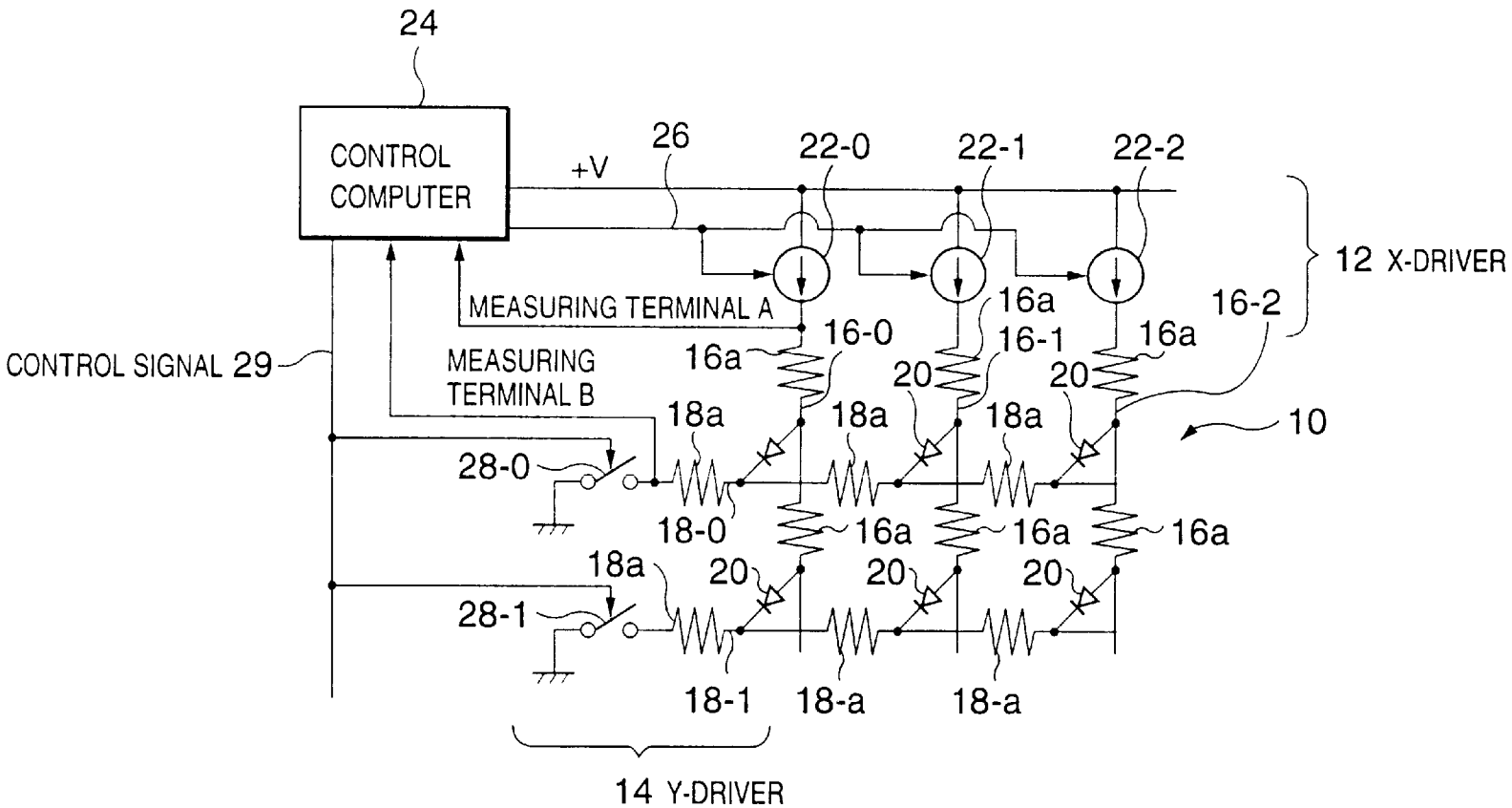
FIG.7 (PRIOR ART)
FIG. 7 is a circuit diagram illustrating a driving circuit for a display device according to a conventional example 1.
Figure 8:
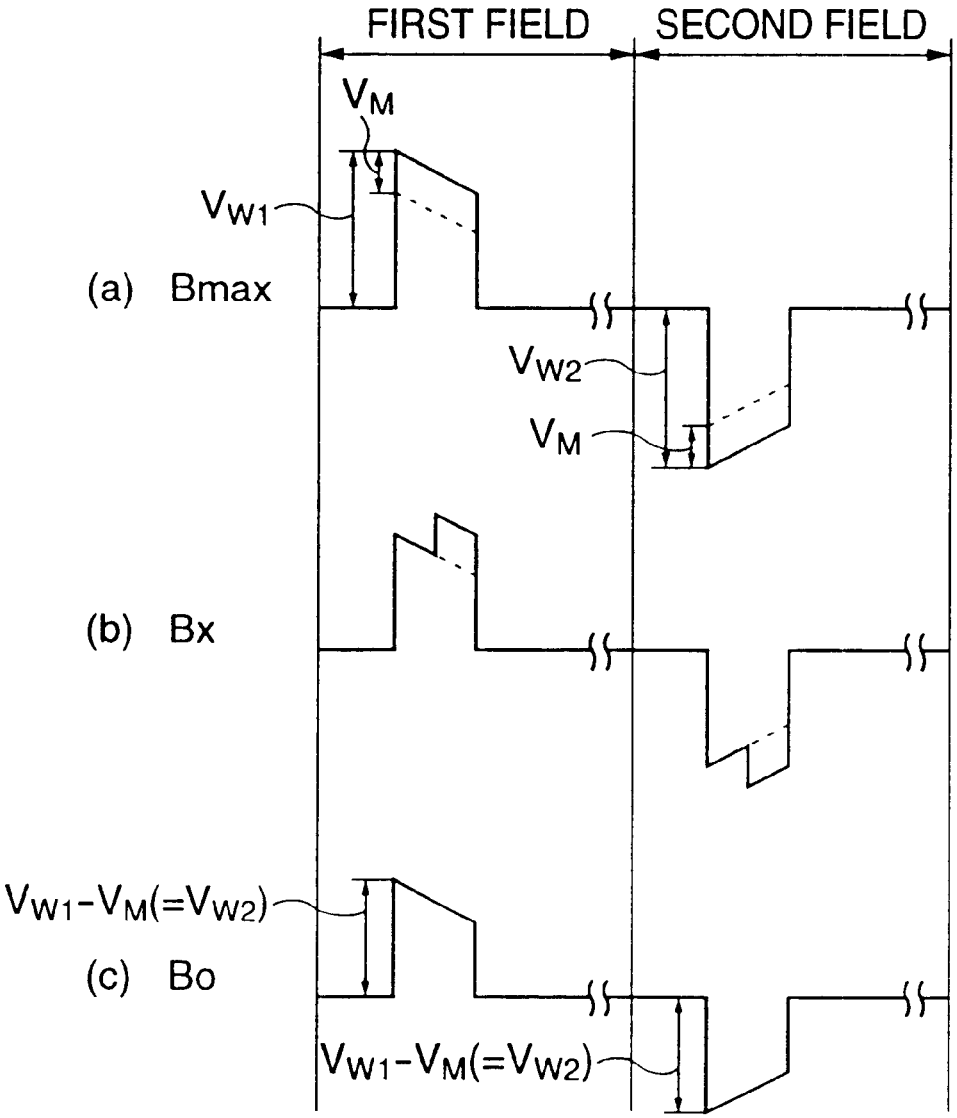
FIG.8 (PRIOR ART)
FIG. 8 is a diagram illustrating a driving pulse waveform for an EL element according to a conventional example 2.

Referring to FIG. 4, a power source voltage +V is supplied to the constant-current source 22 which has a configuration of a current mirror. A reference current Iref is supplied to transistors 90 and 91 arranged in the constant-current source 22. A constant current from the constant-current source 22 is supplied to an EL element 20 through a transistor 92. The transistor 92 allows the constant current to be supplied or intercepted dependently on a driving pulse 26 applied to a base thereof. A value of the constant current supplied to the EL element 20 is determined by resistors 93 and 94. A switching transistor 5 is connected to the resistor 93, one of the two resistors which determine the value of the current, for enabling to short both ends of the transistor 93. The switching transistor 5 is connected through an inverter 6 so that the transistor 5 is made conductive by a pulse having a width tb which is created by a pulse generator 1. In the second embodiment, a charger circuit is composed of the switching transistor 5 and the inverter 6.

When the pulse generator creates the pulse having the width tb, the switching transistor 5 is turned on for a period tb, thereby shorting the resistor 93. Since one transistor 93 of the resistors 93 and 94 which determine the current value is shorted, a total resistance of these resistors are reduced, whereby an increased current which is determined by the resistor 94 is supplied to the EL element 20. The current modulator circuit 4 functions to increase a current supplied to the EL element for the period tb as described above.

A pulse which is applied to the EL element in the second embodiment is in the condition of OBPQ which is shown in FIG. 2 and the same as that in the first embodiment. A rise time $\tau$ of this pulse is determined dependently on a time constant which in turn is determined by resistance of the switching transistor 5 in its on condition and a junction capacity of the EL element, and can therefore be set sufficiently short as compared with the width T of the driving pulse as in the first embodiment. That is, lowering of luminance is scarcely problematic when a ratio of the resistor 93 relative to the resistor 94 is adequately selected and the duration of the output tb from the pulse generator is adjusted to approximately $\tau$=2 $\mu$s so that it is sufficiently short as compared with the total pulse width T=104 $\mu$s.

Figure 13:
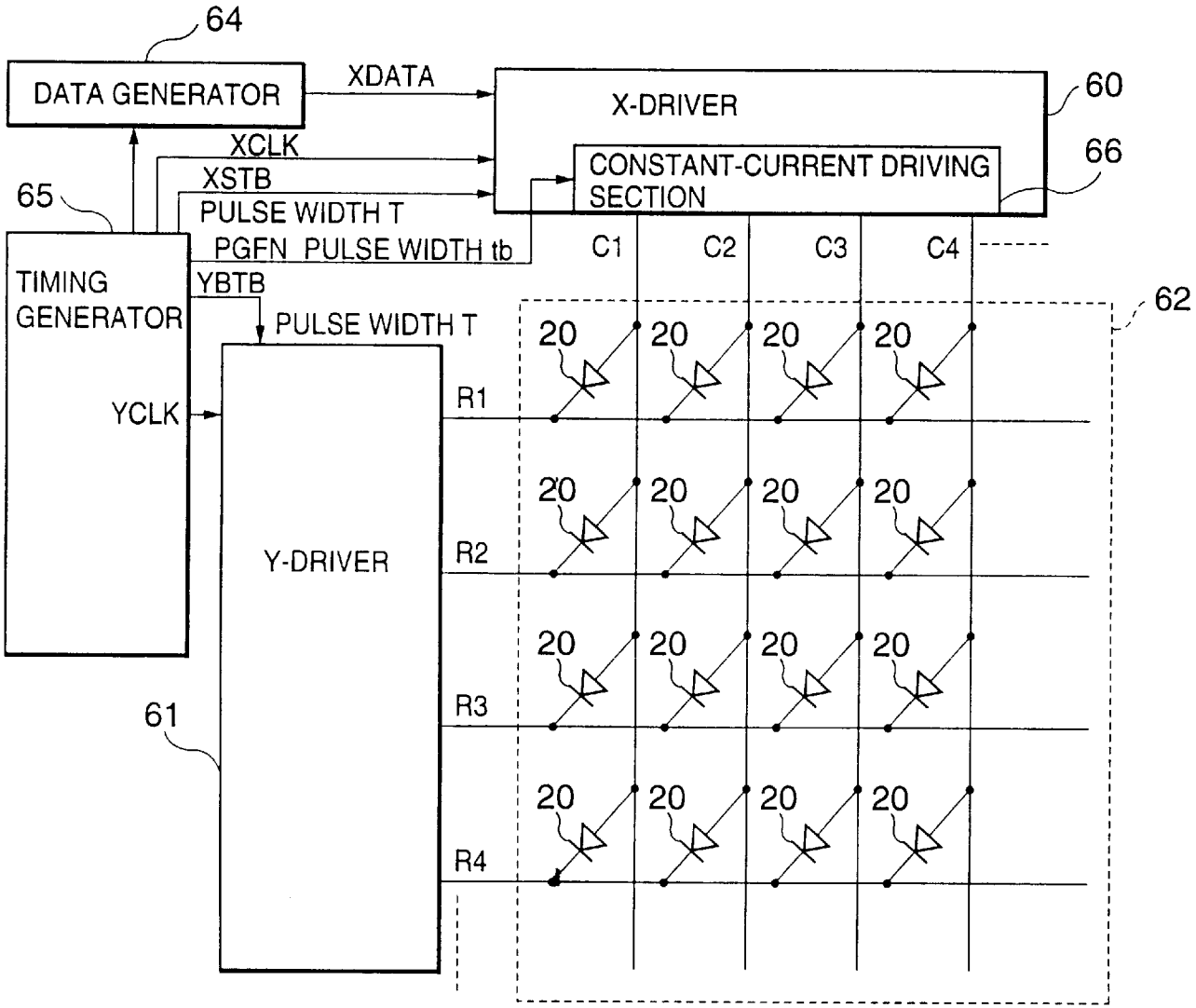
FIG. 13 is a diagram illustrating an overall circuit composition of an embodiment of the present invention.

FIG. 13 shows a configuration of a driving circuit for a matrix of organic thin film EL elements according to the present invention. In FIG. 13, an X driver 60 drives column lines (signal electrodes) C1, C2, C3, . . . on an EL panel 62, whereas a Y driver 61 drives row lines (scanning electrodes) R1, R2, R3, . . . on the EL panel 62. A data signal (XDATA) which is created by a data generator 64 and timing signals (XCLK, XSTB and PGEN) for the X driver which are created by a timing generator 65 are input into the X driver 60. Further, timing signals (YCLK, YSTB, etc.) for the Y driver which are created by the timing generator 65 are input into the Y driver 61. Describing these signals with reference to FIG. 4 which is descriptive of the circuit for a single element, the data signal (XDATA) is a signal for determining Iref and XSTB is the driving pulse which has the width T.

Disposed in the X driver 60 is a constant-current driving section 66 in which the circuit according to the present invention (shown in FIG. 4, etc. illustrating the first and second embodiments) is connected to each output. PGEN which is created by the timing generator 65 corresponds to the output from the pulse generator 1 shown in FIGS. 3 and 4, and functions to input a pulse having a width tb into a current modulator circuit. When XSTB and PGEN are raised simultaneously, these two pulses rise with no time delay at a time when they are output from the timing generator 65, but rise of the driving pulse (XSTB) is retarded due to a junction capacity of the EL element at a time when XSTB is output from the constant-current driving section 66 of the X driver 60. By operating the current modulator circuit according to the present invention utilizing PGEN having the pulse width tb which originally rises simultaneously, it is possible to drive the EL element with no substantial time delay. Speaking concretely, it is possible to raise the driving pulse with a time delay of approximately 2 us as described above.

FIGS. 14 through 17 show timing charts of output signals from the X driver 60 and the Y driver 61. Driving waveforms for the X driver and the Y driver are shown in FIGS. 14 through 17. In these drawings, the EL element is ignited when the waveform for the Y driver is at an L level and the waveform for the X driver is at an H level.

Figure 9:
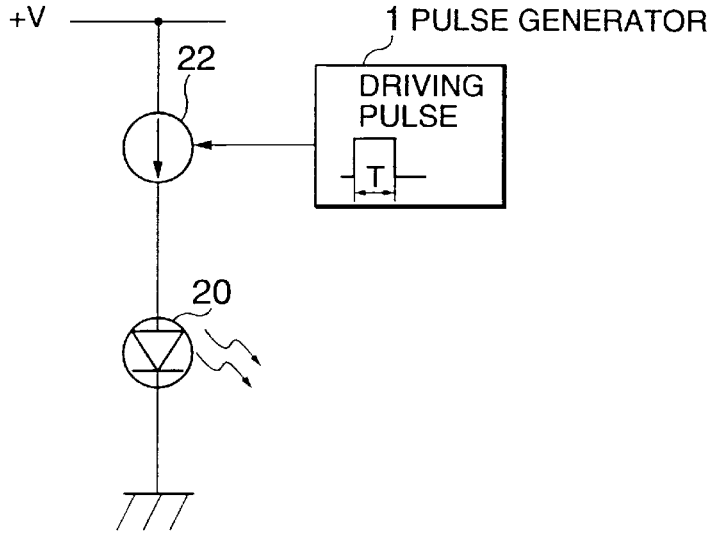
FIG.9 (PRIOR ART)
FIG. 9 is a block diagram of a circuit corresponding to a single picture element according to the conventional example 1.
Figure 14:
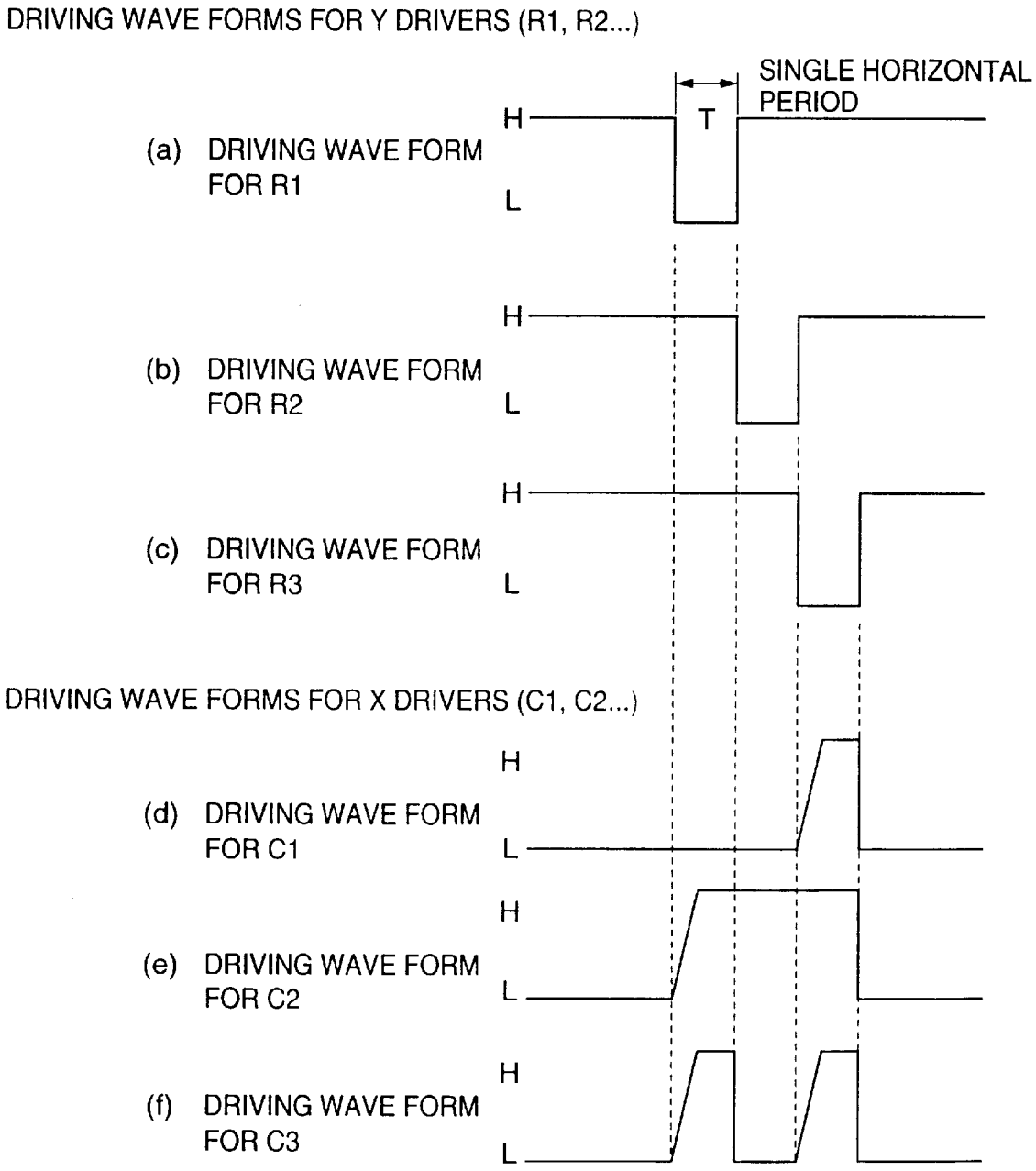
FIG. 14 is a timing chart of a conventional driving circuit.

FIG. 14 shows driving waveforms for conventional X driver and Y driver. The X driver 60 comprises a conventional circuit which is configured as shown in FIG. 9. The Y driver outputs driving pulses sequentially as R1, R2, R3, . . . which have a horizontal width T and are not overlapped with one another. In case of the conventional example shown in FIG. 14, a rise of the X driver is delayed due to the junction capacity of the EL element.

Figure 15:
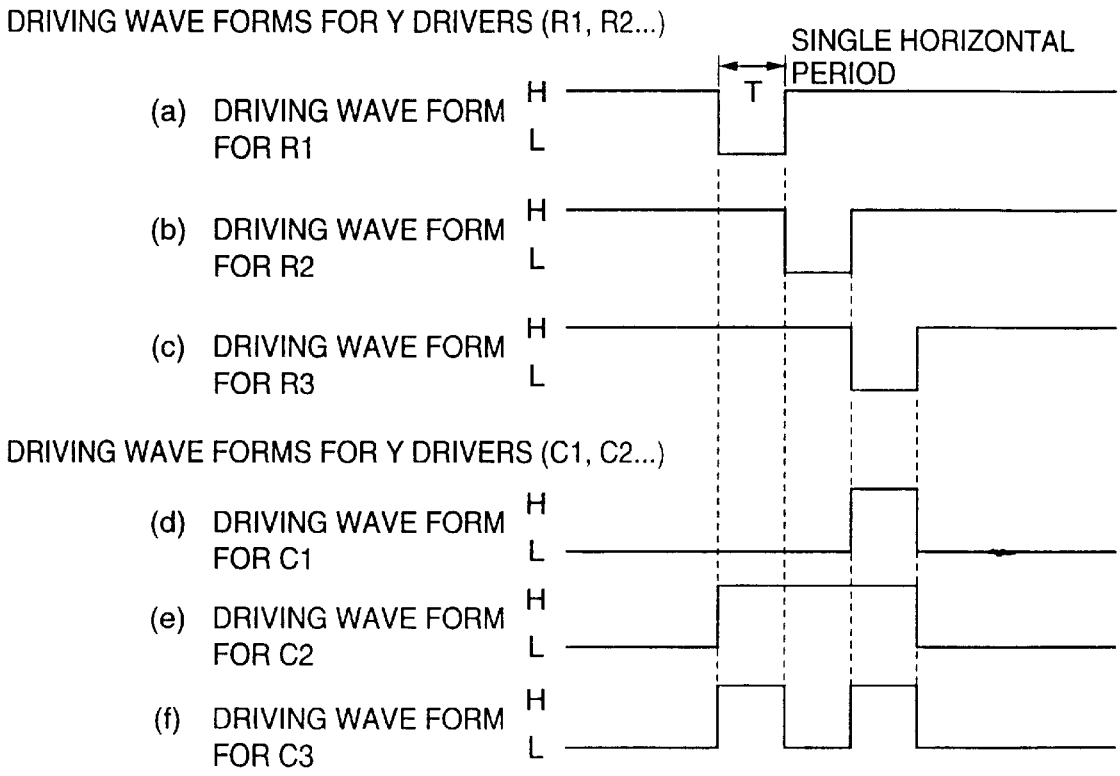
FIG. 15 is a timing chart of a driving circuit in the second embodiment of the present invention.

FIG. 15 shows driving waveforms for the X driver and the Y driver in the driving circuit according to the present invention. The rise of the driving waveform for the X driver is improved by adding the charging circuit according to the present invention as described with reference to FIG. 2.

Figure 16:
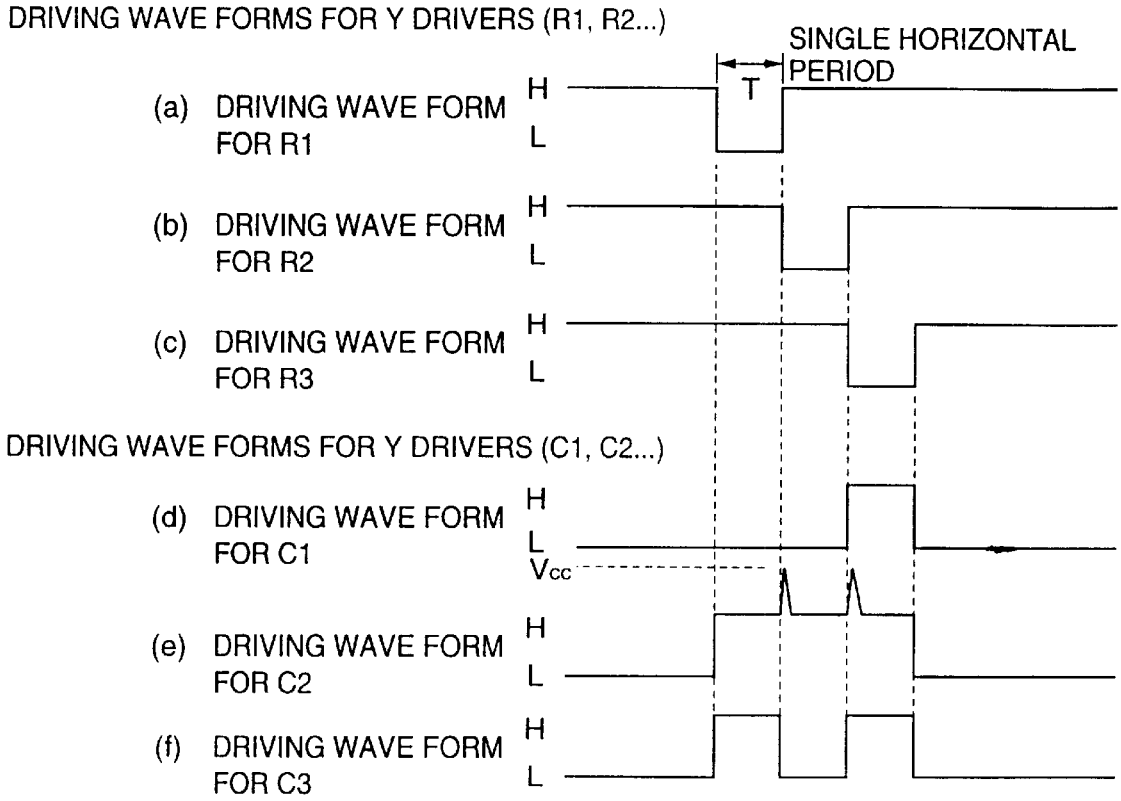
FIG. 16 is a timing chart of a driving circuit according to the present invention.

When a screen displays outputs from the X driver which are successively at the H level as shown in FIG. 16(*e*) in the driving circuit according to the present invention, there may occur a phenomenon that charges are not discharged from the EL element and the charging circuit according to the present invention charges more than required, thereby enhancing pulses to a level in the vicinity of Vcc as shown in FIG. 16(*e*), enhancing luminance to a level which is different from that raised from the L level.

Figure 17:
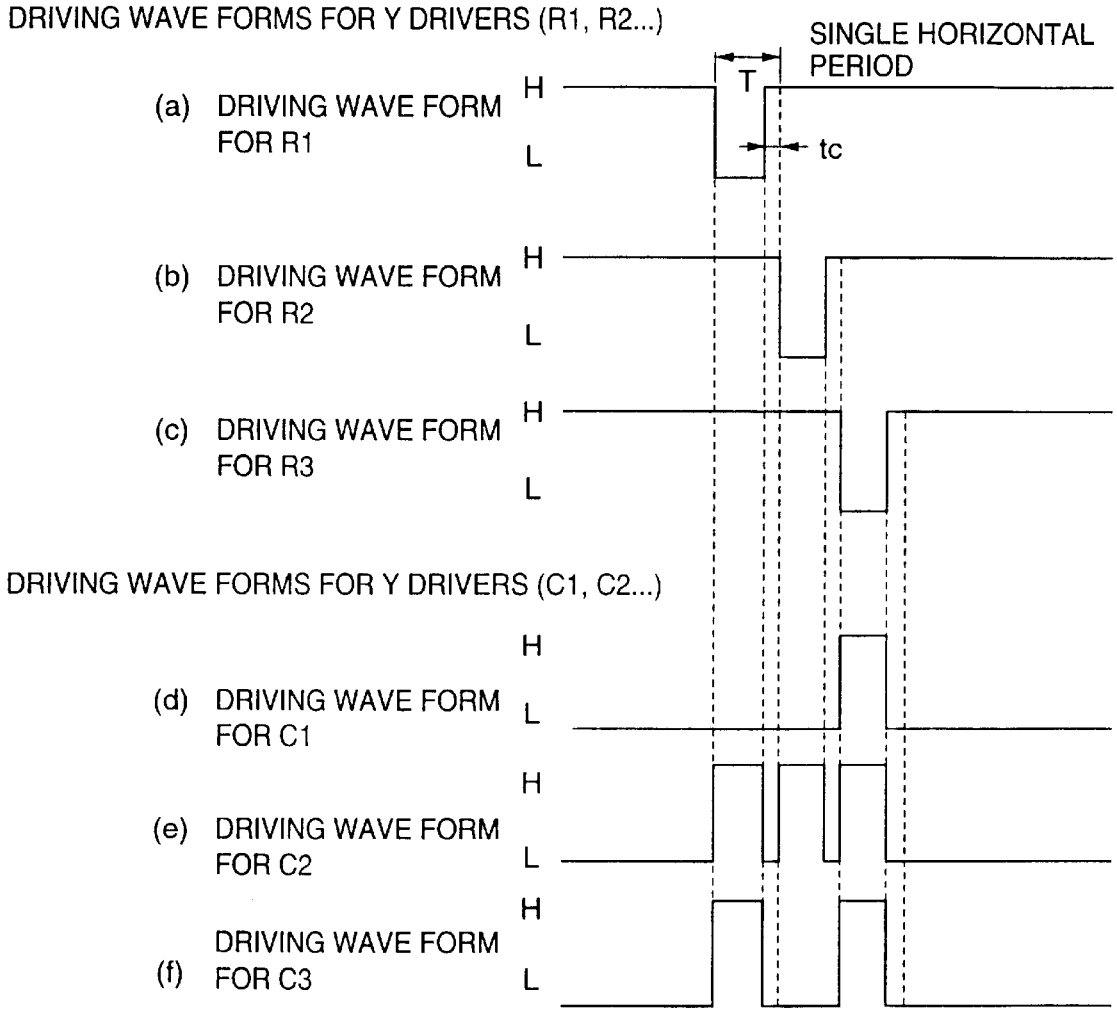
FIG. 17 is a timing chart of a driving circuit in a third embodiment of the present invention.

A third embodiment corrects such a phenomenon by shortening a horizontal period at an L level from T to tc as shown in FIG. 17. When a period of the Y driver is shortened as shown in FIG. 17, the EL element is ignited for a shorter time, and waveforms for the X driver are intermittent at interval of a single pulse as shown in (d), (e) and (f) in FIG. 17, thereby preventing the charging circuit according to the present invention from charging more than required and correcting the phenomenon of the difference in luminance on a screen between the case of the pulses which are successively at the H level and the case of pulses which are alternately at the H and L levels.

For obtaining a period (T−tc) of the driving pulse for the Y driver as shown in FIG. 17, it is sufficient to modify a pulse width of YSTB from the timing generator 65 from T to (T−tc). Though the time to must be long enough to allow electric charges accumulated in the organic EL element to be discharged, too long tc lowers luminance. Therefore, tc is to be determined while taking lowering of luminance into consideration. Speaking concretely, it is adequate to select a value on the order of 10 μs for tc judging from a fact it is about 7 μs when a duty of 1/64, a driving period of 150 Hz and a pulse amplitude of 10V are selected at the falling time PQ shown in FIG. 2. This value of tc can suppress lowering of luminance within 10% assuming that T has a value of 104 μs.

Figure 18:
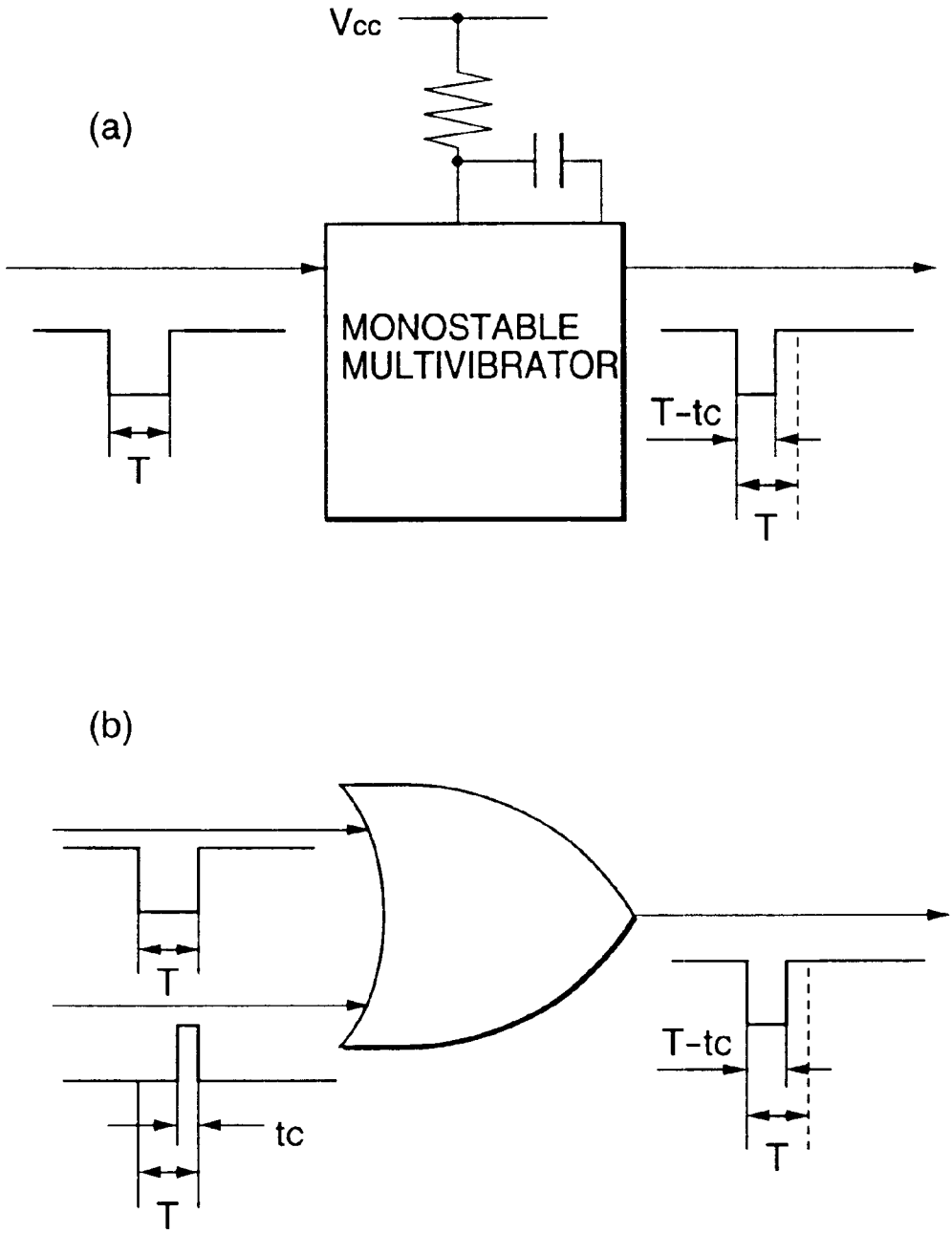
FIG. 18 is a diagram descriptive of a driving circuit in a third embodiment of the present invention.

Speaking concretely, a circuit shown in FIG. 18(*a*) or 18(*b*) is usable in the timing generator 65 for modifying the period T of the period of the driving pulse for the Y driver to the period (T−tc) as shown in FIG. 17. The circuit shown in FIG. 18(*a*) shortens the period T to the period (T−tc) using a monostable multivibrator. The circuit shown in FIG. 18(*b*) creates a pulse having the period (T−tc) by forming a logical sum of a pulse having the period T and a pulse having the period tc. Such a circuit permits easily modifying a pulse width of YSTB from the timing generator 65 from T to (T−tc).

As understood from the foregoing description, the present invention disposes a charger circuit which charges an EL element to a predetermined potential with an output from a pulse generator at a driving rise time of the EL element in current driving means which supplies a constant-current driving signal in a driving circuit for organic thin film EL elements.

When luminance is different between a case of EL elements which are successively ignited due to too high an effect of the charger circuit caused dependently on contents on a screen and a case of the EL elements which are not ignited successively, a width of pulses on a scanning side is made shorter than a single scanning period.

Accordingly, the charging circuit according to the present invention is capable of charging a junction capacity of the EL elements in a short time and driving EL elements without delaying rise of pulses, thereby making it possible to suppress lowering of luminance even with capacitive EL elements when signal electrodes are driven with square pulse signals dependently on input signals.

Further, the present invention makes it possible to prolong service lives of the EL elements since it eliminates the necessity to supply too high a current for obtaining required luminance without correcting delayed rise of driving pulses, thereby preventing the EL elements from being heated in waste.

When periods of scanning pulses are made narrower, the EL elements are ignited for a shorter time and the driving pulses are made intermittent at short intervals, whereby the charging circuit according to the present invention does not charge the EL elements more than required.

What is claimed is:

1. A driving circuit for driving a matrix of a plurality of organic electroluminescent elements comprising light-emitting layers made of an organic substance and signal electrodes and scanning electrodes, said electrodes holding the light-emitting layers therebetween, said driving circuit comprising a current driving circuit having an output node coupled to said organic electroluminescent elements and generating a driving current at said output node during a driving pulse supplied thereto, said driving pulse including a first period of time, a second period of time following said first period of time, said driving current having a first current value during said first period of time and a second current value during said second period of time, said organic electroluminescent elements being driven by said driving current having said first and second current values to enhance luminance of said organic electroluminescent elements within a period of said driving pulse, electric charges accumulated in said organic electroluminescent elements within said driving pulse for a scanning electrode being discharged before a period of said driving pulse for the following scanning electrode to restrain excessive charging in the following period of said driving pulse.

2. The driving circuit according to claim 1, wherein said second current value is smaller than said first current value.

3. The driving circuit according to claim 1, wherein said period for discharging electric charges is set in said period of said driving pulse.

4. The driving circuit according to claim 3, wherein said period for discharging electric charges is set in an end of said period of said driving pulse.

5. The driving circuit according to claim 1, wherein said current driving circuit includes a current source generating a current of said second current value in response to said driving pulse at said output node, a pulse generator generating a trigger pulse in synchronization with said driving pulse during said first period of time, and a switch responding to said trigger pulse to electrically couple said output node to a power voltage line.

6. The driving circuit according to claim 1 wherein said current driving circuit includes a pulse generator generating a trigger pulse in synchronization with said driving pulse during said first period of time, a current source producing said first current value in response to said trigger pulse and thereafter producing said second current value, and a switch coupled between said current source and said organic electroluminescent element and turned on in response to said driving pulse.

7. A driving circuit for driving a matrix of a plurality of organic electroluminescent elements comprising:

light-emitting layers made of an organic substance; and signal electrodes and scanning electrodes, these electrodes holding the light-emitting layer therebetween, wherein said driving circuit comprises;

a current source circuit for supplying a direct current driving current to said organic thin film electroluminescent elements in response to a first pulse signal;

a pulse generator responsive to receipt of said first pulse signal and for outputting a second pulse signal in synchronization with said first pulse signal, and a charging circuit which charges a junction capacitance of said organic thin film electroluminescent elements to a predetermined potential responsive to said second pulse signal to shorten a period in which said junction capacitance is charged, wherein a current which is a sum of said driving current and said junction capacitance is supplied to said organic thin film electroluminescent elements to enhance luminance within a period of said first pulse signal and electric charges accumulated in said organic electroluminescent elements within said driving pulse for a scanning electrodes being discharged before a period of said driving pulse for the following scanning electrode to restrain excessive charging in the following period of said driving pulse by said charging circuit.

8. The driving circuit according to claim 7 wherein a pulse width of said second pulse signal is narrower than a pulse width of said first pulse signal.

9. The driving circuit according to claim 7, wherein said period for discharging electric charges is set in said period of said driving pulse.

10. The driving circuit according to claim 9, wherein said period for discharging electric charges is set in an end of said period of said driving pulse.

* * * * *